US008075375B2

(12) United States Patent
Kegley

(10) Patent No.: US 8,075,375 B2
(45) Date of Patent: Dec. 13, 2011

(54) METHOD AND APPARATUS FOR BALANCING AN HVAC SYSTEM

(76) Inventor: John T. Kegley, Franklin, IN (US)

( * ) Notice: Subject to any disclaimer, the term of this patent is extended or adjusted under 35 U.S.C. 154(b) by 1201 days.

(21) Appl. No.: 11/823,632

(22) Filed: Jun. 29, 2007

(65) Prior Publication Data

US 2009/0004965 A1 Jan. 1, 2009

(51) Int. Cl.
*F24F 13/08* (2006.01)
*F24F 7/00* (2006.01)

(52) U.S. Cl. ..... 454/284; 454/310

(58) Field of Classification Search ..... 454/284, 454/310

See application file for complete search history.

(56) References Cited

U.S. PATENT DOCUMENTS 3,063,356 A * 11/1962 Fitt ..... 454/312
3,087,407 A * 4/1963 Averill et al. ..... 454/312
5,207,615 A * 5/1993 Edmisten ..... 454/322

* cited by examiner

*Primary Examiner* — Steve McAllister
*Assistant Examiner* — Kosanovic Helena
(74) *Attorney, Agent, or Firm* — Daniel O'Connor

(57) ABSTRACT

A method and apparatus for balancing an HVAC system. The method involves using a plate which is circular in shape and has four inner cut-out portions which are capable of being manually removed by an operating engineer. To reduce flow to a minimum, all four rings are left on the plate. To allow a progressively greater amount of air flow, more rings are removed from the circular plate. Such enables the equalization of the various rooms in an HVAC system without the addition of costly upstream dampers. The circular plate is attached to a duct via four small protruding ear elements.

1 Claim, 8 Drawing Sheets

METHOD AND APPARATUS FOR BALANCING AN HVAC SYSTEM

BACKGROUND AND OBJECTS OF THE INVENTION

The present invention is generally related to the heating, ventilating and cooling (HVAC) arts in general and, in particular, to a novel metering orifice system and method of use.

Prior art HVAC ducting systems typically require the addition of a damper device with an associated access door in order to effectively control the air flow to a desired area.

Such damper air flow control devices are effective but costly and time consuming to install and use in practice.

HVAC maintenance and installing engineers are frequently called upon to balance a larger system by providing a certain desired air flow to a particular room or area.

Such must be done with precision and in a time-effective manner so the HVAC building customer is pleased with the outcome.

Accordingly, it is an object of the present invention to set forth a novel product comprising an adjustable metering orifice which allows the user to meter, adjust and/or proportion air flow in HVAC ducts.

It is also an object to describe a method of proportioning air flow in ducts in an economical manner, i.e. without having to install costly dampers and access means.

It is a further object of the invention to show a multi-orifice system which is initially fabricated as a unitary system which has breakaway components and retaining elements for ease of use by an installing and system adjusting engineer.

The system may be economically manufactured for widespread commercial appeal by those of skill in the HVAC arts.

These and other objects and advantages of the system and method of use will be apparent to those of skill in the art.

PRIOR ART PATENTS AND DESIGNS

During the course of preparing this specification for submission to the U.S. Patent and Trademark Office, a full search of the prior art was conducted.

U.S. Pat. No. 7,174,918 issued to Stevenson in 2007 teaches the use of an air flow control valve as part of an air conditioning module.

U.S. Pat. No. 5,228,475 issued to Trill in 1993 shows the use of an air flow control unit as used in a vehicle compartment.

U.S. Pat. No. 4,407,187 shows a ventilating air control device to regulate flow of air in a duct.

The invention is believed to be classified in Class 98 related to Ventilating Systems.

The particular structure and method of use for the structure are believed to be clearly patentable over all known designs in the heating, ventilating and air conditioning arts.

SUMMARY OF THE INVENTION

In order to eliminate hot spots or cold spots in a heating, ventilating and air conditioning (HVAC) system, a plate having four inner cut-out areas or removable portions is added to a duct just before it enters a room. To reduce air flow to a minimum, all of the cut-out portions or rings are left on the plate.

To allow more air flow to a room to be equalized, progressively more rings are removed from the plate by a systems operating engineer.

The plate includes four small outer protruding ear portions which are used, in conjunction with the more flexible portions of standard ducting, to mount the plate securely yet removably to the ducting.

The design saves system adjustment time and achieves a more balanced system in a very cost-effective manner.

The plates utilized may be easily removed and replaced as needed for future system adjustments.

BRIEF DESCRIPTION OF THE DRAWING FIGURES

FULL DESCRIPTION OF THE PREFERRED EMBODIMENTS

Figure 1:
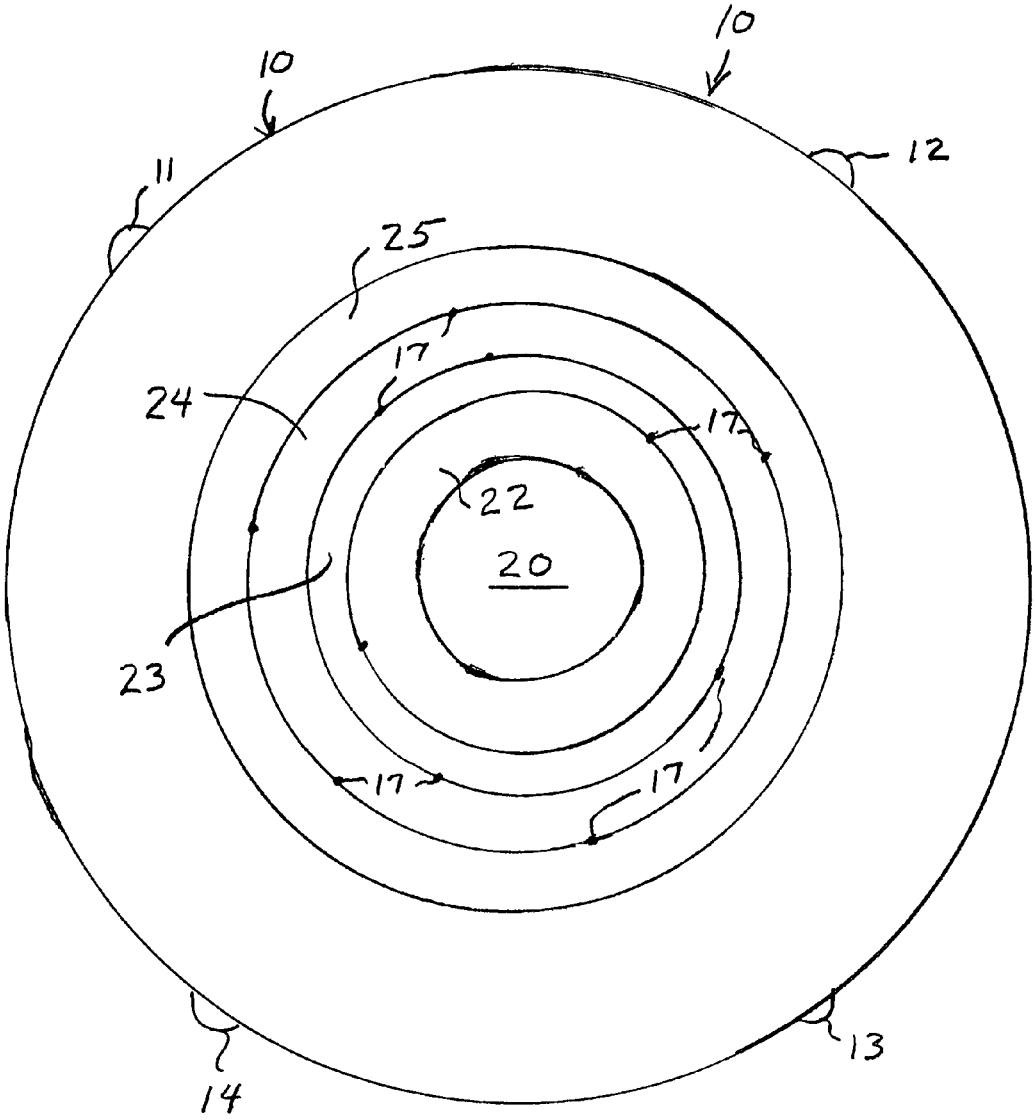
FIG. 1 is a top view of a variable flow regulating plate as utilized in the inventive method.

Referring to the drawing FIG. 1, the overall adjustable metering orifice unit is indicated at numeral 10 as having four duct attaching elements 11, 12, 13 and 14 to be further described.

The unit 10 has a central open area 20 to permit air flow.

The unit further has breakaway sections indicated at numerals 22, 23, 24 and 25. The breakaway sections are releasably attached to the unit and to each other by means of the connector elements indicated at the various numerals 17.

When the unit of FIG. 1 is placed in a HVAC duct, a certain measurable volume of air passes through the central opening 20.

Should a greater volume of air be needed to serve a certain area or room, as determined by an expert systems/installing engineer, the breakaway section 22 is removed to permit increased air flow.

As will be appreciated, the progressive sections 23, 24 and 25 may be broken away as needed to provide a certain desirable air flow.

Figure 2:
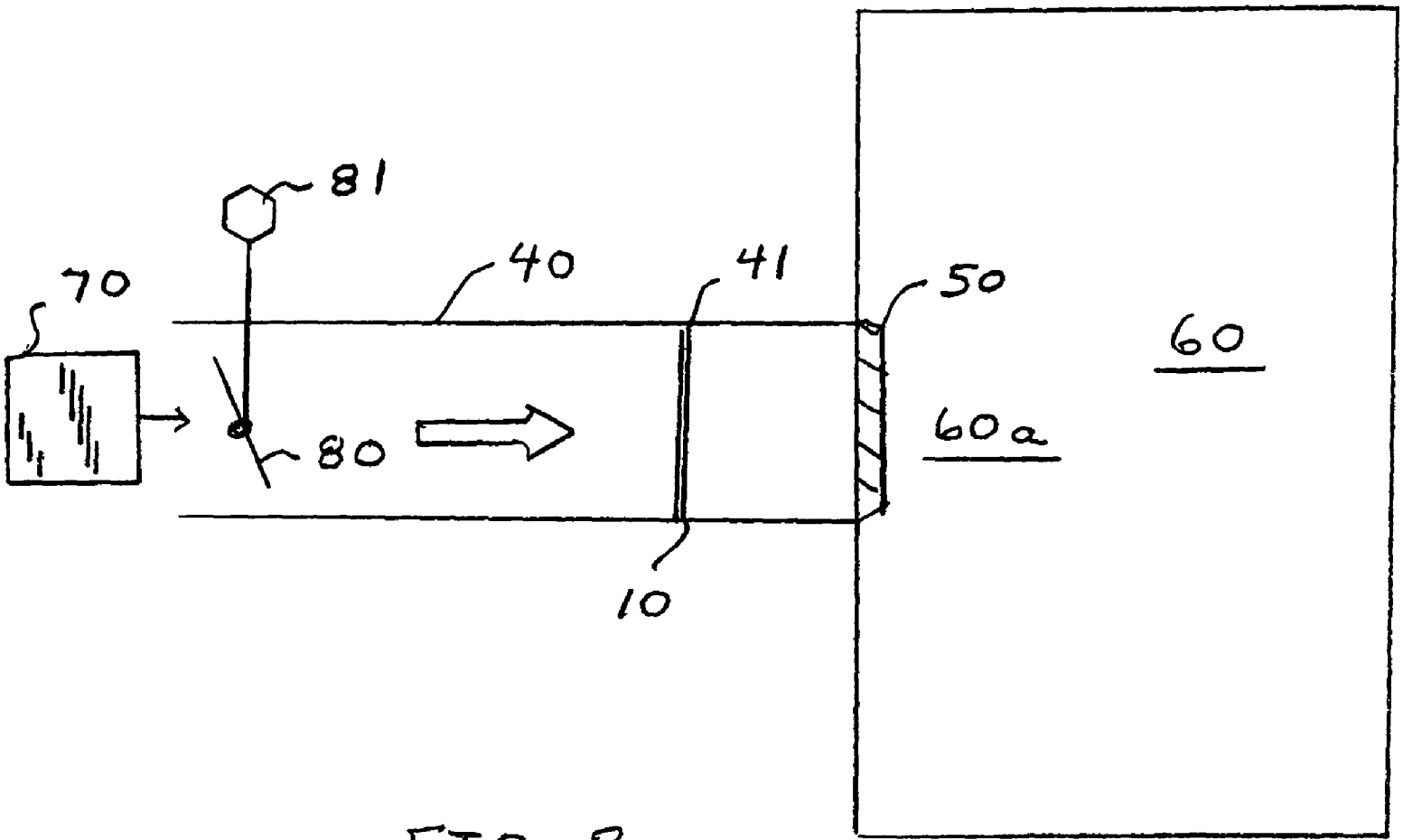
FIG. 2 is a basic example of how a metering plate is placed in an HVAC system to regulate air flow.

FIG. 2 shows an overall system view and illustrates the method of the invention.

FIG. 2 shows a duct 40 having an area 41 which is near a discharge register, diffuser or grille 50 (to cite terms used in the art).

The register 50 directs air flow into a room 60 which has a region **60*a*** at which the volume of air flow can be measured by an installing or system adjusting engineer.

FIG. 2 also shows the schematic HVAC system at 70 and a remote damper 80 operated via a type of controller 81 conventionally utilized in the HVAC and related arts.

In practice of the inventive method, the metering unit 10 is placed at area 41 of the duct 40 by simply removing the grille or register 50.

After the metering unit 10 has been placed in the duct at area 41 near the grille 50, the installing engineer can measure the air flow and system pressure at point 60*a*.

If such measurements are not as desired, the metering unit 10 can be easily changed by, for example, progressively removing sections 22, 23, 24 and 25 depending upon the particular conditions desired.

In such manner, the system flow can be accurately adjusted without the installing engineer having to go back to the remotely located damper 80.

Thus, significant amounts of time are saved and a more accurate system adjustment can be performed in a newly installed or existing heating, ventilating and air conditioning system.

It is contemplated that the adjustable metering unit 10 would be circular in shape to conform to most ducting, although other shapes, e.g. square or rectangular, may also be utilized.

Figure 3:
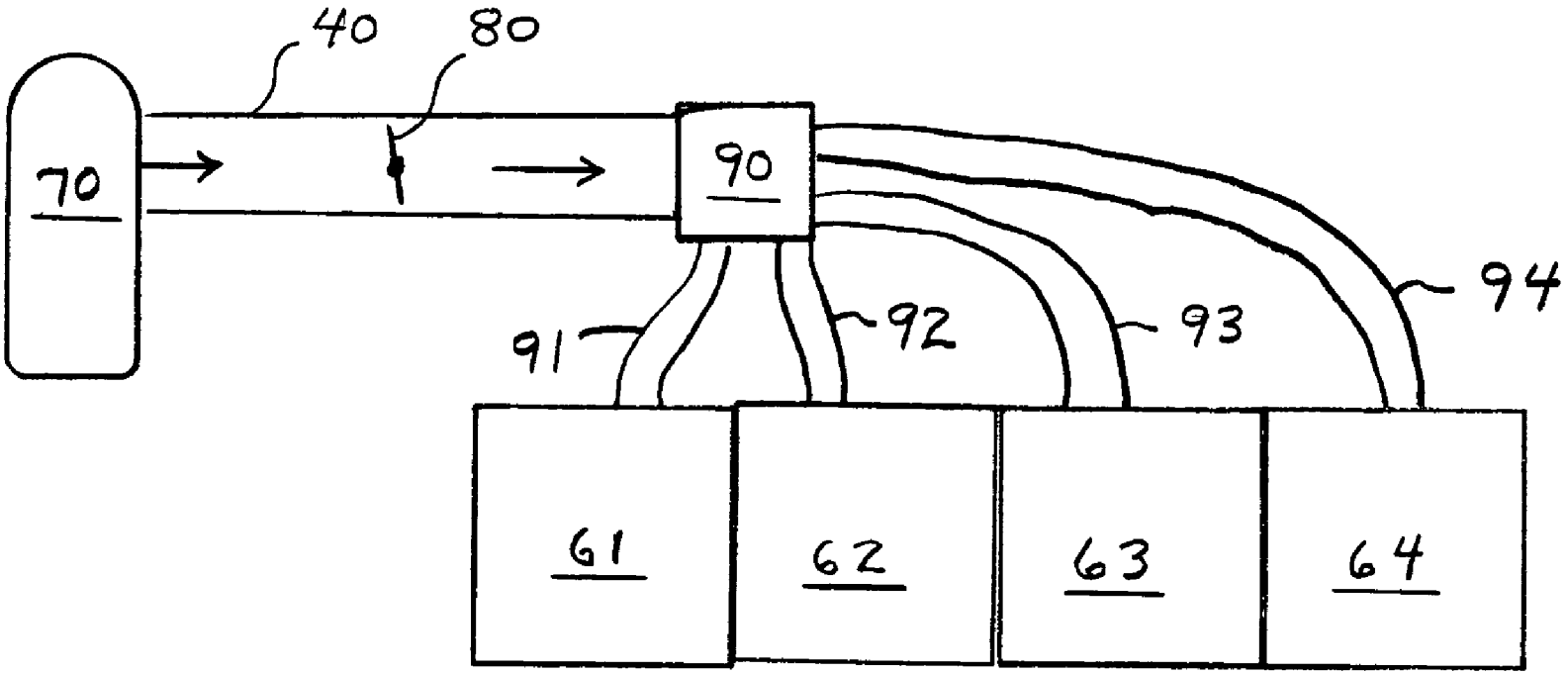
FIG. 3 illustrates a four room system to be balanced and related ducting and junction box units.

FIG. 3 illustrates a larger system view which may, for example, comprise the office areas or zones on one floor of a building.

The HVAC unit 70 supplies cool or warm air via a larger duct 40 and damper 80 to a junction box shown at numeral 90. Junction box 90 is generally an enclosed, sealed compartment and comprises a distribution point for the supplied air.

The exit points from junction box 90 comprise ducts 91, 92, 93 and 94 and supply cool or warm air to rooms or zones 61, 62, 63 and 64 respectively.

As an example concerning original system design, it may have been assumed that office area 61 would accommodate four persons and four personal computers. Thus, to maintain a comfortable temperature of 72° F., a certain duct sizing and positioning would be designed. However, if office 61 ends up having only one person therein, the heat load is much lower than anticipated. Thus, the person occupying office 61 would most likely report the room to be too cold.

As is appreciated by systems engineers practicing in the HVAC arts, the remedy for such a "too cold" condition may be very costly and time consuming.

The flexible nature of duct 91 does not allow the installation of a conventional damper therein. To place a damper inside the closed and sealed junction box 90 would be time consuming, costly and difficult.

Similar problems may occur down the line in offices 62, 63 and 64 where a certain "typical average heat load" does not in fact exist.

This is the problem confronting the engineer assigned to balance or equalize a complex system with variable heat loads.

Especially in office building locations, the air outlet to the particular office is typically in the ceiling and not readily accessible to the occupant.

It has been discovered by the inventor herein that a specially designed metering and variable orifice unit can be utilized to remedy the situation.

Figure 4:
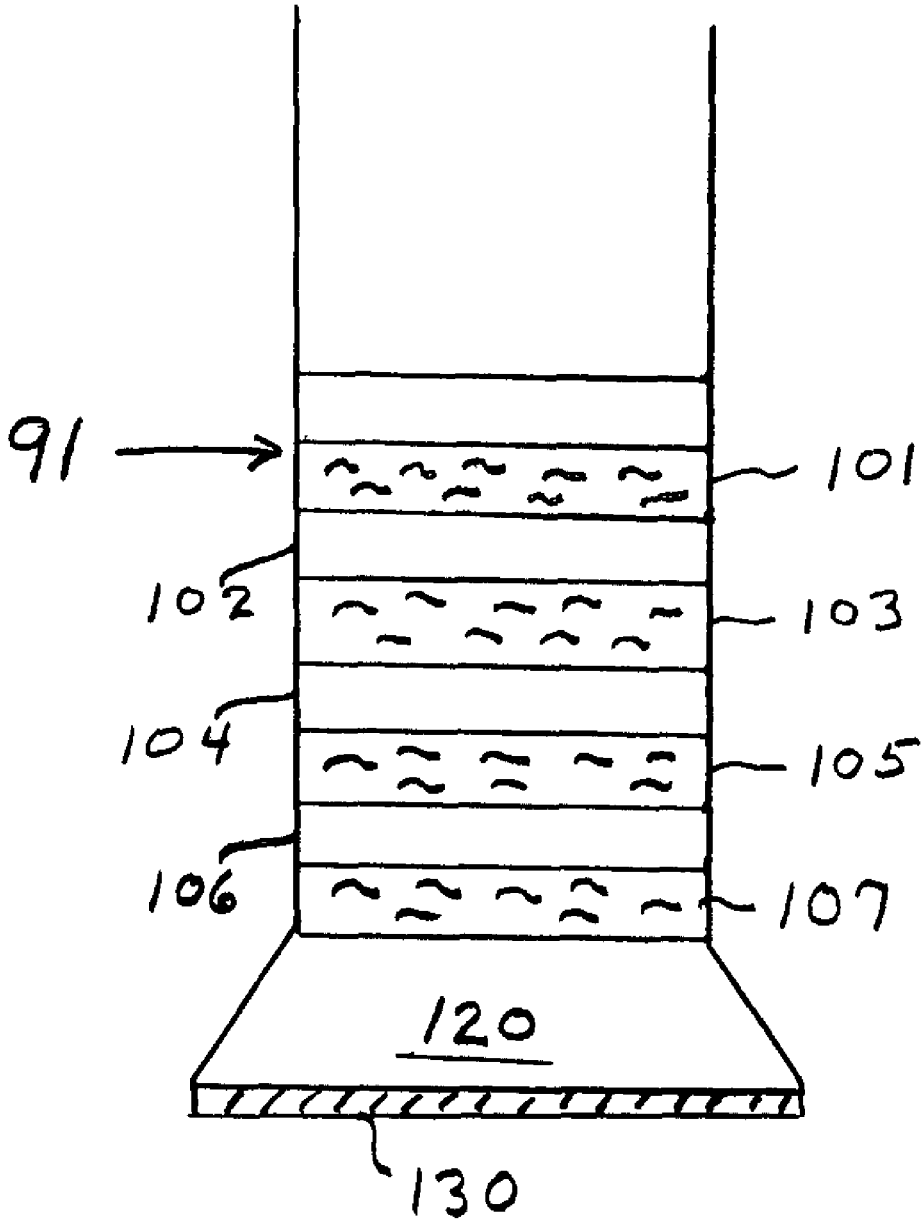
FIG. 4 shows the end portion of a ducting element in association with a diffuser box and discharge grille.

Referring to FIG. 4, it is seen that a typical duct 91 used in the art is comprised of a series of alternating flexible portions such as reinforced cloth shown at numerals 101, 103, 105 and 107.

Duct 91 is further comprised of alternating harder sections 102, 104 and 106. Duct 91 is thus both durable and flexible.

The lower end of duct 91 is shown as attached to a typically rectangular diffuser element 120 having a removable grille 130 attached thereto.

Figure 5:
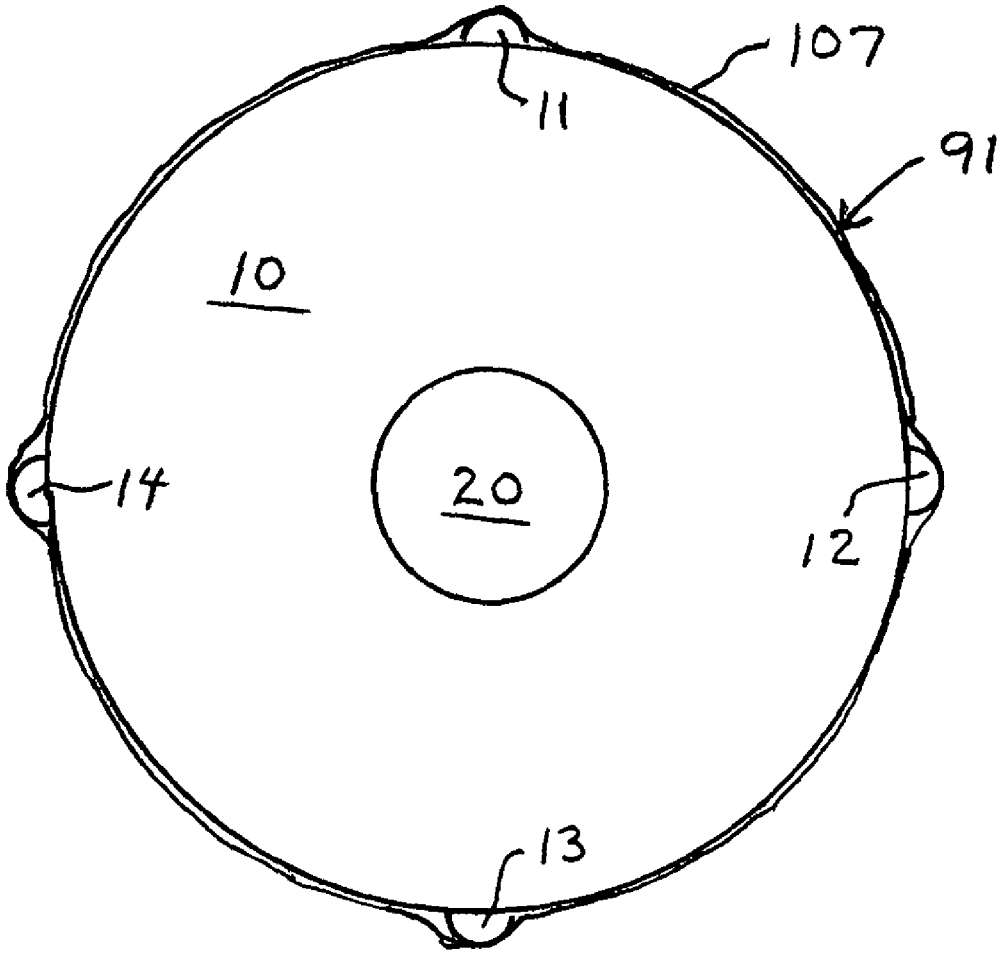
FIG. 5 is a view of the metering plate as placed in a duct and shows the method of removable attachment via the small protruding ears.

Referring to FIG. 5, the air flow regulator 10 having central opening 20 is shown as installed in flexible section 107 of duct 91. As indicated, the small protruding ear elements 11-14 and thus the unit 10 are retained by the flexing action the material in duct section 107. Thus, unit 10 is secured in place and can also be easily removed as needed.

Figure 6:
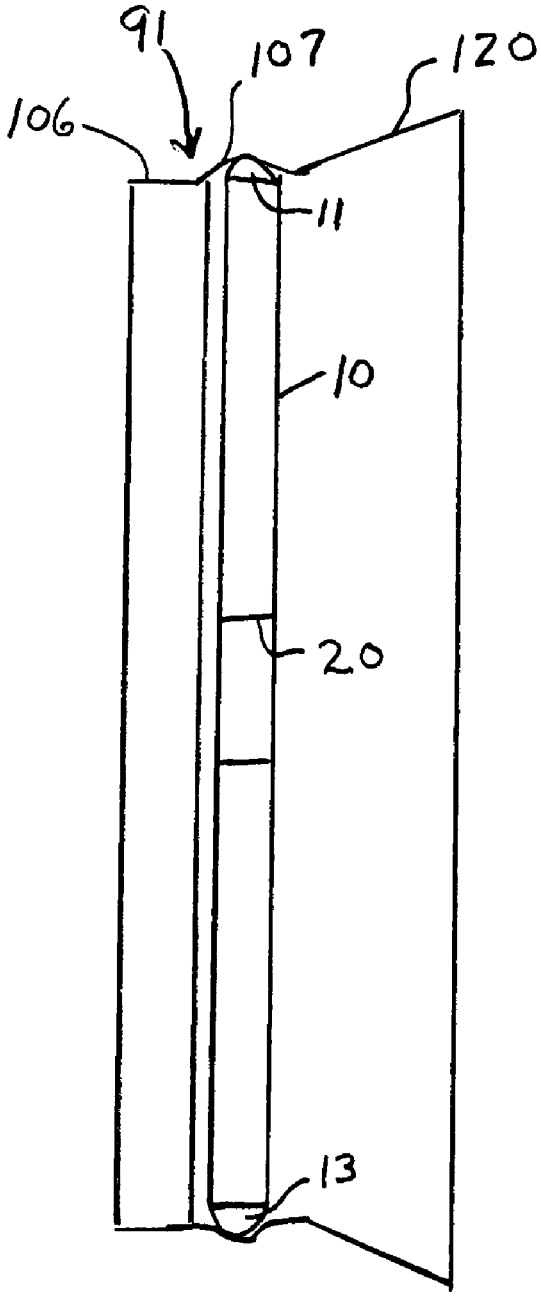
FIG. 6 is a side schematic view of the flow regulating plate as installed in the flexible portion of an HVAC duct.

In the side schematic view of FIG. 6, the flow regulating plate 10 having central opening 20 is again shown as being retained in flexible area 107 of duct 91.

In the FIG. 6 view, the small protruding ears 11 and 13 are shown in relation to flexible duct area 107. Also indicated are the duct portion 106 and a part of the diffuser box 120.

Referring back to FIG. 3, it is noted that air flow regulating units can be installed in any or all of the ducts 91, 92, 93 and 94 as needed to balance a particular system.

Referring to FIGS. 7-10, the air flow metering and regulating plate 10 is shown with progressive ring sections removed to effect a variable air flow as needed.

Figure 7:
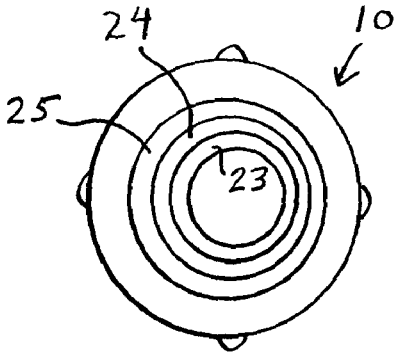
FIGS. 7-10 show the flow regulator plate with various rings removed to allow progressively more air to flow to a room depending upon how a system needs to be balanced under particular high heat load or low heat load conditions.

In FIG. 7, ring 22 is removed.

Figure 8:
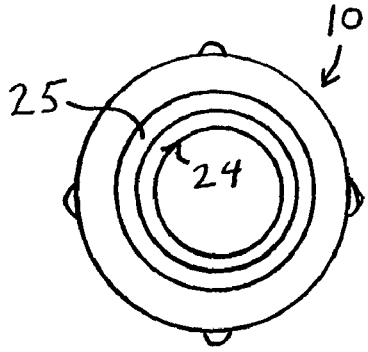

In FIG. 8, ring 23 is removed.

Figure 9:
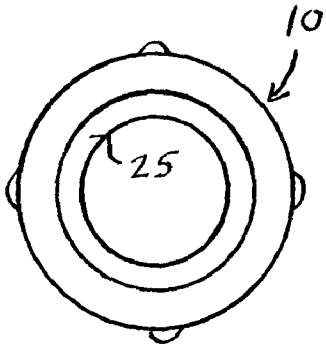

In FIG. 9, ring 24 is removed.

Figure 10:
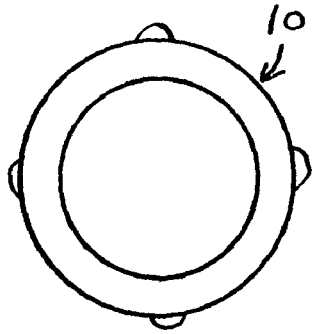

In FIG. 10, ring 25 is removed to create the maximum air flow when the unit 10 is installed in a duct. The rings are manually removed by the HVAC engineer.

Figure 11:
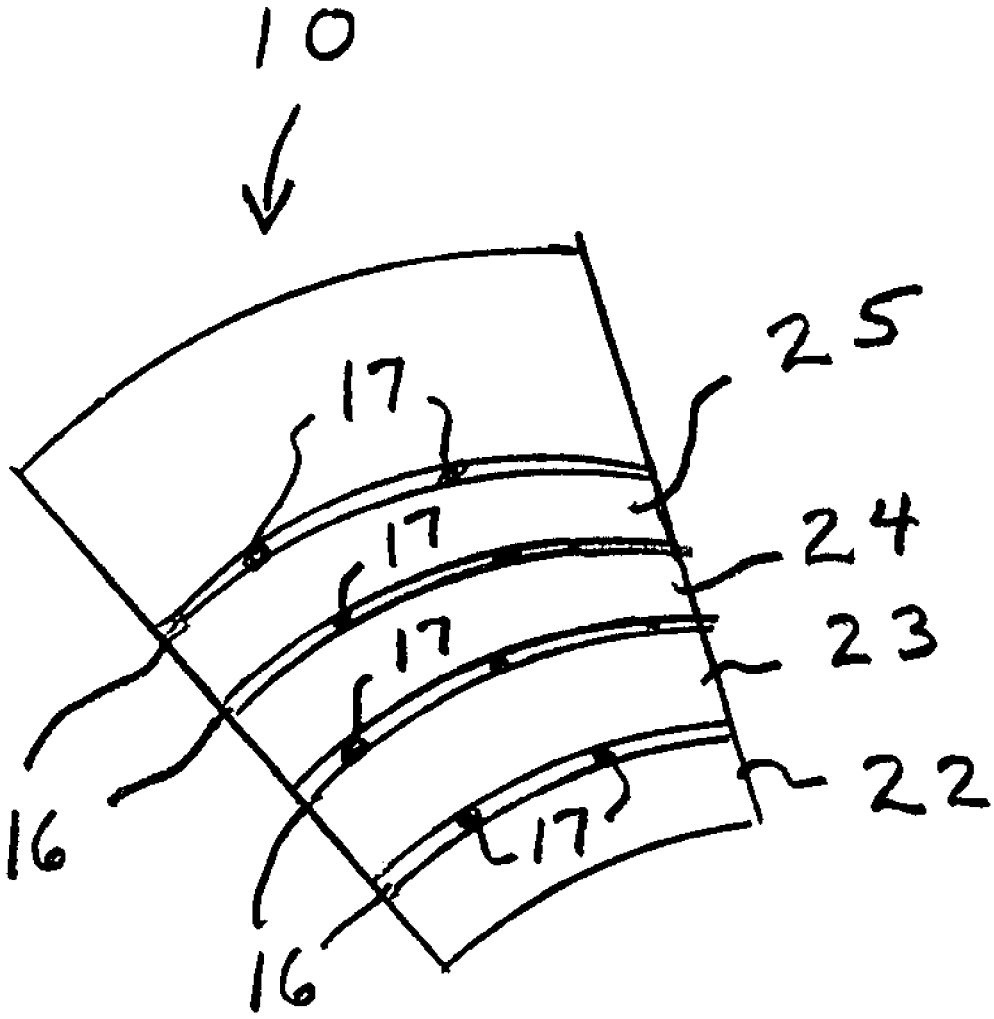
FIG. 11 shows structure of the air flow regulator.

FIG. 11 shows detailed structure of the air flow metering and regulating unit 10. A partial section of unit 10 is shown.

A plurality of very small cuts 16, on the order of only 0.01 inch, are precision machine made to form the various rings 22-25. The rings are then spot-welded back together as indicated at numerals 17.

Such construction enables the rings 22-25 to be progressively removed at the option of the system engineer as a part of the balancing/equalizing process.

It is contemplated that the unit 10 would be made steel or equivalent durable materials and that various sizings would be made to accommodate particular duct sizes. The unit 10 could have an outer diameter on the order of 6 inches, 8 inches etc. for example.

In practice of the overall balancing method, it is noted that a single unit 10 could be placed in any of the supply ducts 91-94 and adjusted by the system engineer as needed.

While a particular structure and method of use have been shown and described, it is intended to cover equivalent structures and methods of use which would reasonably occur the those of skill in the art. For example, the unit 10 could be utilized in many types of HVAC systems other than described in FIG. 3. Also, the method of attaching unit 10 to a duct or other part of an HVAC system could be achieved by equivalent fastener means. The invention is further defined by the claims appended hereto.

I claim:

1. A method of balancing and equalizing a heating, ventilating and air conditioning system comprising the steps of: placing a flow regulating and metering plate in a flexible duct leading to a room to be heated or cooled, wherein the plate includes four inner removable ring elements, the plate further including four outer attaching elements, removing an intermost ring to allow more air flow to a room to be heated or cooled, wherein progressively more rings are removed to allow more air to flow to a desired area, wherein the inner removable ring elements are flat in shape and, before removal, lie in the same plane with an outer flat portion of said plate, wherein the inner removable ring elements are are spot welded to each other, wherein the four outer attaching elements are in contact with the flexible HVAC duct(107).

* * * * *